US010718110B1

(12) United States Patent
Bennett et al.

(10) Patent No.: US 10,718,110 B1
(45) Date of Patent: Jul. 21, 2020

(54) INSULATION REVIVING AND TREATMENT APPARATUS AND METHOD

(71) Applicants: Russell Bennett, Gulf Breeze, FL (US); Randy Bennett, Pensacola, FL (US)

(72) Inventors: Russell Bennett, Gulf Breeze, FL (US); Randy Bennett, Pensacola, FL (US)

( * ) Notice: Subject to any disclaimer, the term of this patent is extended or adjusted under 35 U.S.C. 154(b) by 200 days.

(21) Appl. No.: 15/861,720

(22) Filed: Jan. 4, 2018

Related U.S. Application Data

(60) Provisional application No. 62/536,084, filed on Jul. 24, 2017.

(51) Int. Cl.

| | |
|---|---|
| ***B08B 7/04*** | (2006.01) |
| ***E04B 1/92*** | (2006.01) |
| ***B05D 3/04*** | (2006.01) |
| ***B05D 7/24*** | (2006.01) |
| ***B05B 7/24*** | (2006.01) |
| ***B05B 7/12*** | (2006.01) |
| ***B05B 7/00*** | (2006.01) |

(52) U.S. Cl.
CPC ..... *E04B 1/92* (2013.01); *B05B 7/0087* (2013.01); *B05B 7/1218* (2013.01); *B05B 7/2478* (2013.01); *B05D 3/0406* (2013.01); *B05D 7/24* (2013.01)

(58) Field of Classification Search
None
See application file for complete search history.

(56) References Cited

U.S. PATENT DOCUMENTS

| | | | | |
|---|---|---|---|---|
| 5,209,405 | A * | 5/1993 | Robinson | B05B 7/0081 239/290 |
| 6,503,580 | B1 * | 1/2003 | Ruffa | B05B 7/02 204/450 |
| 2012/0082790 | A1 * | 4/2012 | Reynolds | B05B 7/062 427/259 |

* cited by examiner

*Primary Examiner* — Nathan T Leong
(74) *Attorney, Agent, or Firm* — J. Nevin Shaffer, Jr.

(57) ABSTRACT

An insulation reviving and treatment apparatus and method includes an air tube with a first end and a second end and a hollow interior. An opening is provided in the first end and in the second end. A handle is attached to the second end where the handle includes a trigger. An air hose is connected to the handle and to a source of air such that operation of the trigger causes air to exit the opening in the first end. And a baffle is attached to the air tube.

20 Claims, 1 Drawing Sheet

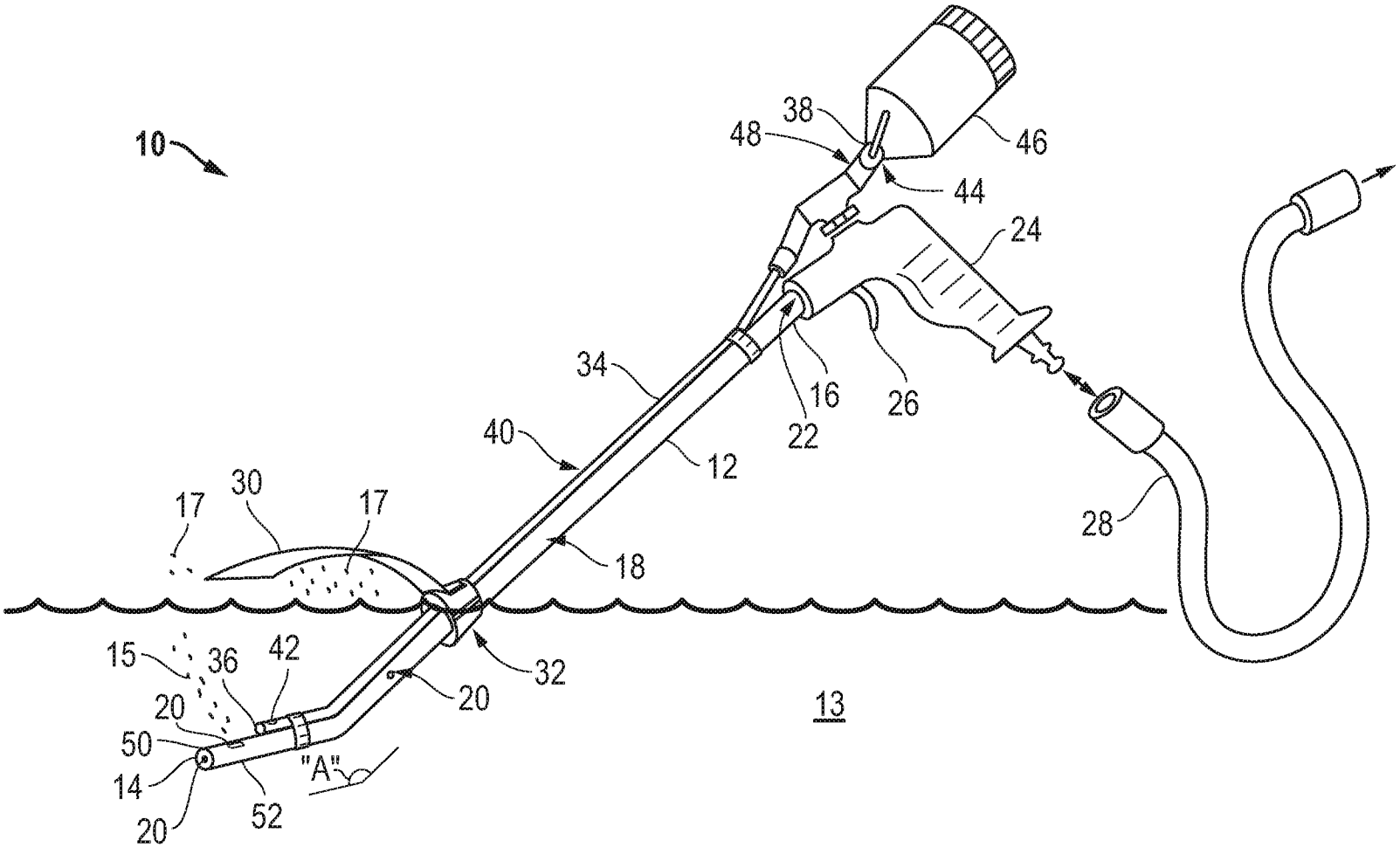
10
13
12
14
15
16
17
17
18
20
20
20
22
24
26
28
30
32
34
36
38
40
42
44
46
48
50
52
"A"

INSULATION REVIVING AND TREATMENT APPARATUS AND METHOD

CROSS REFERENCE TO RELATED APPLICATION

This application claims the benefit of previously filed U.S. provisional patent application No. 62/536,084 for an "Insulation Reviving and Treatment Apparatus and Method". The Applicants hereby claim the benefit of this provisional application under 35 U.S.C. § 119. The entire content of this provisional application is incorporated herein by this reference.

FIELD OF THE DISCLOSURE

The present invention pertains to an insulation reviving and treatment apparatus and method and, in one embodiment, includes an air tube with a first end and a second end and a hollow interior. An opening is provided at the first end and in the second end. A handle is attached to the second end where the handle includes a trigger. An air hose is connected to the handle and to a source of air such that operation of the trigger causes air to exit the opening in the first end. A baffle is attached to the air tube.

BACKGROUND OF THE INVENTION

Insulation becomes compressed over time due to natural forces and/or due to animal or human activity. This reduces the thermal efficiency of the insulation. The present state of the art is to add new insulation on top of the old or replace the old altogether with new insulation. This is a costly and time consuming process. Further, it is often useful to treat existing insulation with product, pesticides, sanitizers, deodorizers, etc. but delivery devices are awkward and often result in the user compressing the insulation further during application.

Thus, there is a need in the art for a process that addresses the aforementioned problems in a manner that is robust and flexible so as to accommodate a full spectrum of insulation scenarios including the treatment of insulation with enhancing products.

It therefore is an object of this invention to provide an apparatus and method for reviving installed insulation that has lost its thermal efficiency that is efficient and inexpensive compared to the alternative of replacing old insulation altogether. It is a further objective to provide at the same time a device for treating insulation with a variety of products such as, for example only and not by way of limitation, sanitizers, pesticides and deodorizers.

SUMMARY

Accordingly, the present invention describes an insulation reviving and treatment apparatus and method which, in one embodiment, includes an air tube with a first end and a second end and a hollow interior. An opening is provided at the first end and in the second end.

A handle is attached to the second end where the handle includes a trigger. An air hose is connected to the handle and to a source of air such that operation of the trigger causes air to exit the opening in the first end. A baffle is attached to the air tube.

All terms used herein are given their common meaning such that "an air tube . . . with a hollow interior" describes a "straw-like" device with a hollow center and a wraparound exterior as in a hollow pipe, for example only and not by limitation. Also, "baffle" describes a device in which the structure of the device that restrains the flow of material. In this application, the baffle protects the user from air and air born material generated by the release of air from the device.

Further, the baffle is rigid in structure and assists in the parting of material and rejuvenation of the same as is more fully described hereafter.

In one aspect, the baffle is attached to the air tube in proximity to the first end of the air tube and extends away from the air tube and toward the first end. In another aspect, the baffle extends over the opening in the first end. In a further aspect, the baffle is attached to the air tube with an adjustable clamp.

In another aspect, the air tube includes a length and more than one air opening along the length as well as at the first end.

In one aspect, the first end of the air tube includes an angled section of the air tube. As illustrated in the FIGURE, the angled section is at the first end only and provides a structure that allows the angled section to be positioned within the insulating material and approximately parallel to the surface of the insulation, for example only and not by way of limitation.

In another aspect, the air tube includes an upper side and a lower side and the opening in the first end is in the upper side.

In one aspect, the apparatus further includes a product tube with a first end and a second end and a hollow interior where the product tube is connected with the air tube. A product opening is provided in the first end and a product opening is also provided in the second end of the product tube. A product container is configured to contain product where the product container is connected to the product opening in the second end of the product tube. A product flow adjuster valve is connected to the product tube such that, upon operation of the trigger, operation of the product flow adjuster flow valve releases product from the product container such that product exits the product opening in the first end of the product tube.

In a further aspect, product is selected from a group of product consisting of: sanitizers, pesticides and deodorizers.

In one aspect, the product opening in the product tube is located at, meaning next to or in proximity with, the opening in the first end of the air tube.

According to another embodiment, an insulation reviving and treatment apparatus consists of an air tube with a first end and a second end and a hollow interior. There is an opening in the first end and another opening in the second end. A handle is attached to the second end and the handle includes a trigger. An air hose is connected to the handle and to a source of air such that operation of the trigger causes air to exit the opening in the first end. A baffle is attached to the air tube as is a product tube with a first end and a second end and a hollow interior. There is a "product" opening in the first end and another "product" opening in the second end of the product tube. A product container, configured to contain product, is connected to the product opening in the second end of the product tube. A product flow adjuster valve is connected to the product tube such that, upon operation of the trigger, operation of the product flow adjuster flow valve releases product from the product container and air draws and pushes product out of the product container such the product exits the product opening in the first end of the product tube.

In one aspect, the baffle is attached to the air tube in proximity to the first end and the baffle extends away from the air tube and toward the first end. In other aspects, the baffle extends over the opening in the first end and the baffle is attached to the air tube with an adjustable clamp.

In a further aspect, the first end of the air tube includes an angled section. In another aspect, the air tube includes an upper side and a lower side and the opening in the first end is in the upper side.

In other aspects, the product is selected from a group of product consisting of: sanitizers, pesticides and deodorizers and the product opening in the product tube is located at the opening in the first end of the air tube.

According to another embodiment of the invention, an insulation reviving and treatment method comprises:

a. providing an air tube with a first end and a second end and a hollow interior; an opening in the first end and an opening in the second end; a handle attached to the second end where the handle includes a trigger; an air hose connected to the handle and to a source of air where operation of the trigger causes air to exit the opening in the first end; and a baffle attached to the air tube: and b. operating the trigger.

In one aspect, the method further includes:

a. a product tube with a first end and a second end and a hollow interior where the product tube is connected with the air tube;

b. a product opening in the first end and a product opening in the second end of the product tube;

c. a product container configured to contain product where the product container is connected to the product opening in the second end of the product tube; and d. a product flow adjuster valve connected to the product tube such that, upon operation of the trigger, operation of the product flow adjuster flow valve releases product from the product container such that product exits the product opening in the first end of the product tube.

In another aspect, the product is selected from a group of product consisting of: sanitizers, pesticides and deodorizers.

DESCRIPTION OF THE DRAWING

Other objects, features and advantages of the present invention will become more fully apparent from the following detailed description of the preferred embodiment, the appended claims and the accompanying drawing in which:

FIG. 1 illustrates a plan view of the insulation reviving and treatment device of the present invention.

DETAILED DESCRIPTION OF EMBODIMENTS

Before explaining at least one embodiment of the invention in detail, it is to be understood that the invention is not limited in its application to the details of construction and to the arrangements of the components set forth in the following description or illustrated in the drawing. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated. For example, further insubstantial approximations of the process and/or structure are also considered within the scope of the invention as described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software based devices, as well as a plurality of different structural components, may be utilized to implement the invention. Furthermore, and as described in subsequent paragraphs, the specific configurations illustrated in the drawing are intended to exemplify embodiments of the invention and that other alternative configurations are possible.

One embodiment of the present invention is illustrated by way of example in FIG. 1. With specific reference to FIG. 1, the insulation reviving and treatment apparatus 10 of the present invention according to one embodiment includes an air tube 12 with a first end 14 and a second end 16 and a hollow interior 18. Further, air tube 12 includes an opening 20 in or at the first end 14 and an opening 22 in the second end 16. Air tube 12 preferably is a rigid, hollow, tube made of aluminum or plastic or any other suitable material now known or hereafter developed.

Handle 24 is attached to the second end 16 and handle 24 includes a trigger 26. Air hose 28 is connected to handle 24 as illustrated and to a source of air, such as an air compressor (not shown for clarity). Air is the preferred motivation medium for the present invention but any useful gas or liquid that may be deemed desirable is included within the scope of the invention.

Once these elements are connected as indicated and illustrated, operation of the trigger 26 causes air, for example only, to exit opening 20 in first end 14 of air tube 12. When air tube 12 is inserted into insulation 13 and insulation reviving and treatment apparatus 10 is operated as just described, air 15 is released within the insulation 13 and thereby causes the insulation 13 to expand from its compressed state, thus reviving the insulation. The exit opening 20 in the current preferred version of the apparatus is close to the first end 14 of the air tube 12 and configured such that the air flow is directed approximately perpendicular to the air tube 12. An alternative configuration of the apparatus can be a curved or bent or angled air tube 12 as at the first end 14 of the air tube 12, as illustrated, which redirects the air flow in a similar manner as to the current version. Certainly, more than one exit openings 20 may be provided along the length of air tube 12, whether air tube 12 is straight or curved or partially straight and partially curved. Again, as should be clear, exit opening 20 may also be configured such that air is directed parallel to air tube 12 either alone or in combination with exit openings 20 elsewhere.

Additionally, a baffle 30 is attached to air tube 12 as illustrated. The baffle 30 serves to aid in breaking up compacted insulation 13 as well as serving as a shield to protect the operator from blown objects and debris 17. In one aspect, the baffle 30 is attached to the air tube 12 with an adjustable clamp 32 such that baffle 30 may be located by a user anywhere along the length of the air tube 12.

FIG. 1 also illustrates a product tube 34 with a first end 36 and a second end 38 and a hollow interior 40 where the product tube 34 is connected with the air tube 12. The FIGURE shows product tube 34 attached to the outside of the air tube 12 and, obviously, product tube 34 may be located within the hollow interior of air tube 12 if desired.

A product opening 42 is provided in or at the first end 36 and another product opening 44 is also provided in the second end 38 of the product tube 34. A product container 46 is configured to contain product (not shown) where the product container 46 is connected to the product opening 44 in the second end 38 of the product tube 34. A product flow adjuster valve 48 is connected to the product tube 34 such that, upon operation of the trigger 26, operation of the product flow adjuster flow valve 48, from closed to open or any position in between, for example only, releases product from the product container 46 such that product exits the opening 42 in the first end 36 of the product tube 34. The "release of the product" is facilitated by the flow of air from the air source such that air flows past the connection of the product container 46 connection with the handle 24 and sucks product out of product container 46 and pushes product out of product opening 42. As with the exit opening in the air tube 12, the product opening 42 is configured such that product exits product tube approximately perpendicular to product tube 34. Likewise, product tube may be curved or bent or partially curved or bent or angled to mirror the shape of the air tube 12, as illustrated. Still further, there may be more than one product opening at the first end 36 of product tube 34 or along its length.

Product, as the term is used herein, includes any substance deemed useful for treatment of insulation such as, for example only and not by way of limitation, sanitizers, pesticides and deodorizers.

Still referring to FIG. 1, air tube 12 can be seen as having an upper side 50 and a lower side 52 and, preferably, opening 20 at the first end 14 of air tube 12 is in the upper side 50 such that air is directed upward through insulation 13 as shown.

Also, preferably, air tube 12 includes an angled section with an angle "A" in the air tube 12 as shown. This angle allows the user to hold the handle 24 at a downward angle and yet still move the first end 14 of air tube 12 approximately parallel to the surface of insulation 13, as illustrated. This ensures compressed air 15 is directed most effectively upward through the insulation.

As is apparent now, the insulation reviving and treatment apparatus and method 10 of the present invention allows a user to revive insulation that has become compressed by using the structures described herein none of which are costly, hard to maintain or difficult to operate. Further, when present, product is deliverable at the same time to the insulation such that not only is old insulation revitalized but it is enhanced with desired treatments as deemed needed.

The description of the present embodiments of the invention has been presented for purposes of illustration, but is not intended to be exhaustive or to limit the invention to the form disclosed. Many modifications and variations will be apparent to those of ordinary skill in the art.

As such, while the present invention has been disclosed in connection with an embodiment thereof, it should be understood that other embodiments may fall within the spirit and scope of the invention as defined by the following claims.

What is claimed is:

1. An insulation reviving and treatment apparatus comprising:

a. an air tube with a first end and a second end and a hollow interior;

b. an opening at said first end and an opening in said second end;

c. a handle attached to said second end wherein said handle includes a trigger;

d. an air hose connected to said handle and to a source of air wherein operation of said trigger causes air to exit said opening in said first end; and e. a baffle attached to said air tube wherein said baffle is attached to said air tube in proximity to said first end and wherein said baffle extends from said air tube toward said first end.

2. The apparatus of claim 1 wherein said baffle extends over the opening in the first end.

3. The apparatus of claim 1 wherein said air tube includes a length and more than one air opening along said length and at said first end.

4. The apparatus of claim 1 wherein said first end of said air tube includes an angled section of said air tube.

5. The apparatus of claim 1 wherein said air tube includes an upper side and a lower side and wherein said opening in said first end is in the upper side.

6. The apparatus of claim 1 further including:

a. a product tube with a first end and a second end and a hollow interior wherein said product tube is connected with said air tube;

b. a product opening in said first end and a product opening in said second end of said product tube;

c. a product container configured to contain product wherein said product container is connected to said product opening in said second end of said product tube; and d. a product flow adjuster valve connected to said product tube such that, upon operation of said trigger, operation of said product flow adjuster flow valve releases product from said product container such that product exits said product opening in said first end of said product tube.

7. The apparatus of claim 6 wherein said product is selected from a group of product consisting of: sanitizers, pesticides and deodorizers.

8. The apparatus of claim 6 wherein said product opening in said product tube is located at said opening in said first end of said air tube.

9. An insulation reviving and treatment apparatus comprising:

a. an air tube with a first end and a second end and a hollow interior, b. an opening at said first end and an opening in said second end such that air flow is directed perpendicular to the air tube;

c. a handle attached to said second end wherein said handle includes a trigger;

d. an air hose connected to said handle and to a source of air wherein operation of said trigger causes air to exit said opening in said first end;

e. a baffle attached to said air tube;

f. a product tube with a first end and a second end and a hollow interior wherein said product tube is connected with said air tube;

g. a product opening in said first end and a product opening in said second end of said product tube;

h. a product container configured to contain product wherein said product container is connected to said product opening in said second end of said product tube; and i. a product flow adjuster valve connected to said product tube such that, upon operation of said trigger, operation of said product flow adjuster flow valve releases product from said product container such the product exits said product opening in said first end of said product tube.

10. The apparatus of claim 9 wherein said baffle is attached to said air tube in proximity to said first end and wherein said baffle extends from said air tube and toward said first end.

11. The apparatus of claim 10 wherein said baffle extends over the opening in the first end.

12. The apparatus of claim 9 wherein said baffle is attached to said air tube with an adjustable clamp.

13. The apparatus of claim 9 wherein said first end of said air tube includes an angled section of said air tube.

14. The apparatus of claim 9 wherein said air tube includes an upper side and a lower side and wherein said opening in said first end is in the upper side.

15. The apparatus of claim 9 wherein said product is selected from a group of product consisting of: sanitizers, pesticides and deodorizers.

16. The apparatus of claim 9 wherein said product opening in said product tube is located at said opening in said first end of said air tube.

17. The apparatus of claim 1 wherein said baffle is attached to said air tube with an adjustable clamp.

18. An insulation reviving and treatment method comprising:

a. providing an air tube with a first end and a second end and a hollow interior; an opening in said first end and an opening in said second end; a handle attached to said second end wherein said handle includes a trigger; an air hose connected to said handle and to a source of air wherein operation of said trigger causes air to exit said opening in said first end; and a baffle attached to said air tube and a baffle attached to said air tube wherein said baffle is attached to said air tube in proximity to said first end and wherein said baffle extends from said air tube toward said first end:

b. and operating said trigger.

19. The method of claim 18 further including:

a. a product tube with a first end and a second end and a hollow interior wherein said product tube is connected with said air tube;

b. an opening in said first end and an opening in said second end of said product tube;

c. a product container configured to contain product wherein said product container is connected to said opening in said second end of said product tube; and d. a product flow adjuster valve connected to said product tube such that upon operation of said trigger operation of said product flow adjuster flow valve releases product from said product container such the product exits said opening in said first end of said product tube.

20. The method of claim 19 wherein said product is selected from a group of product consisting of: sanitizers, pesticides and deodorizers.

* * * * *